US008113001B2

(12) United States Patent
Singh et al.

(10) Patent No.: US 8,113,001 B2
(45) Date of Patent: Feb. 14, 2012

(54) TUBULAR FUEL INJECTOR FOR SECONDARY FUEL NOZZLE

(75) Inventors: Arjun Singh, Karnataka (IN); Swanand Vijay Sardeshmukh, Karnataka (IN)

(73) Assignee: General Electric Company, Schenectady, NY (US)

( * ) Notice: Subject to any disclaimer, the term of this patent is extended or adjusted under 35 U.S.C. 154(b) by 625 days.

(21) Appl. No.: 12/241,854

(22) Filed: Sep. 30, 2008

(65) Prior Publication Data

US 2010/0077759 A1 Apr. 1, 2010

(51) Int. Cl.
*F02C 7/22* (2006.01)

(52) U.S. Cl. ..... 60/742; 60/734; 60/737; 60/739; 60/740

(58) Field of Classification Search ..... 60/734, 60/737, 739, 740, 742
See application file for complete search history.

(56) References Cited

U.S. PATENT DOCUMENTS

| | | | | |
|---|---|---|---|---|
| 5,611,684 | A * | 3/1997 | Spielman | 60/737 |
| 5,647,215 | A * | 7/1997 | Sharifi et al. | 60/737 |
| 5,983,642 | A * | 11/1999 | Parker et al. | 60/737 |
| 6,016,658 | A * | 1/2000 | Willis et al. | 60/737 |
| 6,282,904 | B1 | 9/2001 | Kraft et al. | |
| 6,363,725 | B1 * | 4/2002 | Mei et al. | 60/737 |
| 6,446,439 | B1 | 9/2002 | Kraft et al. | |
| 6,460,326 | B2 * | 10/2002 | Bechtel et al. | 60/740 |
| 2006/0168966 | A1 * | 8/2006 | Stuttaford et al. | 60/772 |
| 2008/0078181 | A1 * | 4/2008 | Mueller et al. | 60/776 |

* cited by examiner

*Primary Examiner* — William H Rodriguez
*Assistant Examiner* — Lorne Meade
(74) *Attorney, Agent, or Firm* — Nixon & Vanderhye P.C.

(57) ABSTRACT

A fuel injector for a secondary fuel nozzle in a gas turbine includes axially oriented air slots and a plurality of fuel injection holes disposed between the air slots. The plurality of fuel injection holes include axially oriented injection holes and radially oriented injection holes such that fuel input through the plurality of fuel injection holes is injected in both a radial direction and an axial direction to mix with air flowing through the air slots.

6 Claims, 5 Drawing Sheets

FIG. 6
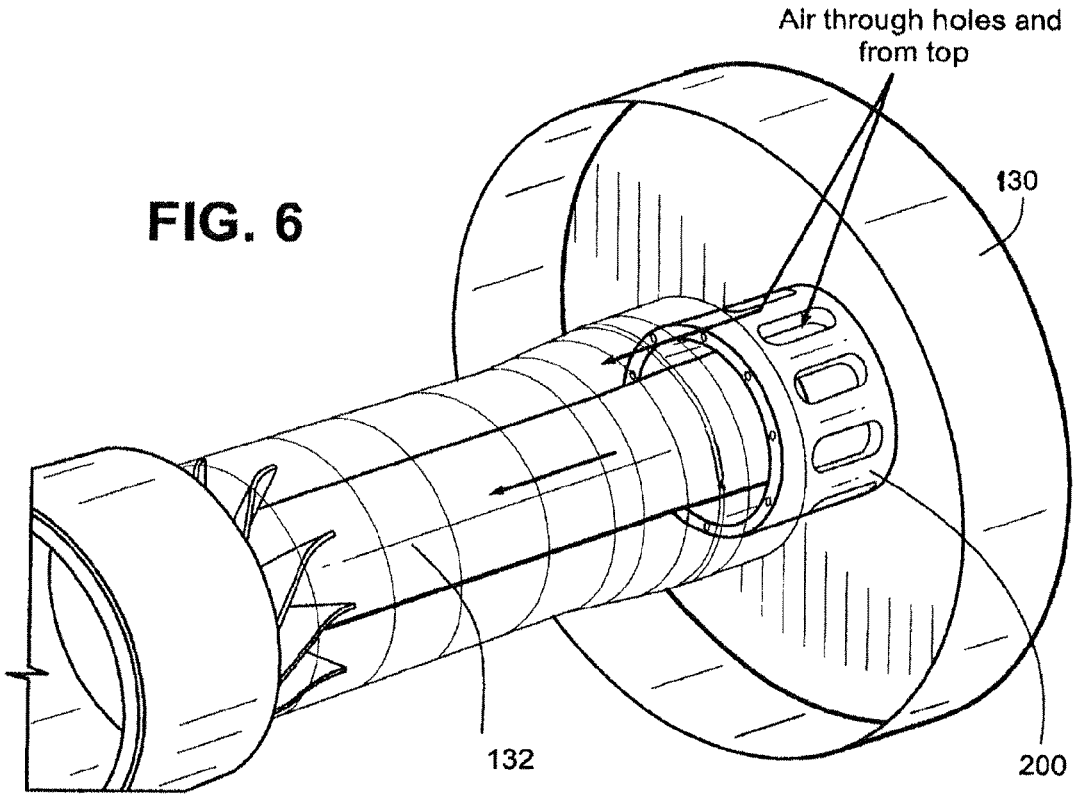
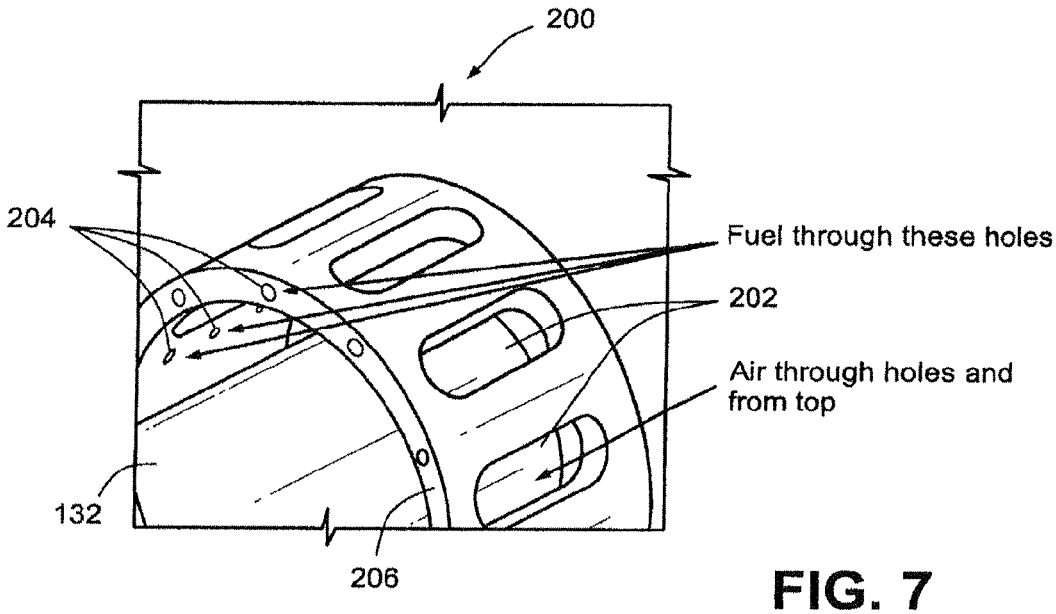
FIG. 7

TUBULAR FUEL INJECTOR FOR SECONDARY FUEL NOZZLE

BACKGROUND OF THE INVENTION

The invention relates to gas turbine combustors and, more particularly, to improvements in gas turbine combustors for reducing air pollutants such as nitrogen oxides (NOx).

Gas turbine engines typically include a compressor section, a combustor section, and at least one turbine section. The compressor compresses air that is mixed with fuel and channeled to the combustor. The mixture is then ignited generating hot combustion gases. The combustion gases are channeled to the turbine, which extracts energy from the combustion gases for powering the compressor, as well as for producing useful work to power a load, such as an electrical generator.

Existing dry low NOx (DLN) combustion systems have a secondary fuel nozzle that provides a flame that supports the primary flame. The fuel/air mixture coming out of the secondary fuel nozzle is not fully premixed and contributes to the NOx production from the gas turbine.

It would be desirable to increase the air/fuel mixedness in the secondary fuel nozzle to enable NOx reduction from the gas turbine.

BRIEF DESCRIPTION OF THE INVENTION

In an exemplary embodiment, a secondary fuel nozzle for a gas turbine includes a fuel manifold coupled with a plurality of annular fuel passages, and a tubular fuel injector in fluid communication with the fuel manifold and disposed surrounding the plurality of annular fuel passages. The tubular fuel injector includes a plurality of axially oriented air slots and a plurality of fuel injection holes disposed between the plurality of air slots. The plurality of fuel injection holes are oriented such that fuel from the fuel manifold is injected in at least a circumferential radial direction to mix with air flowing through the plurality of air slots.

In another exemplary embodiment, a secondary fuel nozzle for a gas turbine includes a fuel manifold coupled with a plurality of annular fuel passages, and a tubular fuel injector in fluid communication with the fuel manifold and disposed surrounding the plurality of annular fuel passages. The tubular fuel injector includes a plurality of axially oriented air slots disposed about a circumference of the tubular fuel injector and a plurality of fuel injection holes disposed between the plurality of air slots. The plurality of fuel injection holes include axially oriented injection holes and radially oriented injection holes such that fuel from the fuel manifold is injected in both a radial direction and an axial direction to mix with air flowing through the plurality of air slots.

In still another exemplary embodiment, a fuel injector is provided for a secondary fuel nozzle in a gas turbine. The fuel injector includes axially oriented air slots and a plurality of fuel injection holes disposed between the air slots. The plurality of fuel injection holes include axially oriented injection holes and radially oriented injection holes such that fuel input through the plurality of fuel injection holes is injected in both a radial direction and an axial direction to mix with air flowing through the air slots.

BRIEF DESCRIPTION OF THE DRAWINGS

FIG. 6 is a perspective view showing a fuel nozzle tubular fuel injector; and FIG. 7 is a close-up view of the tubular fuel injector.

DETAILED DESCRIPTION OF THE INVENTION

Figure 1:
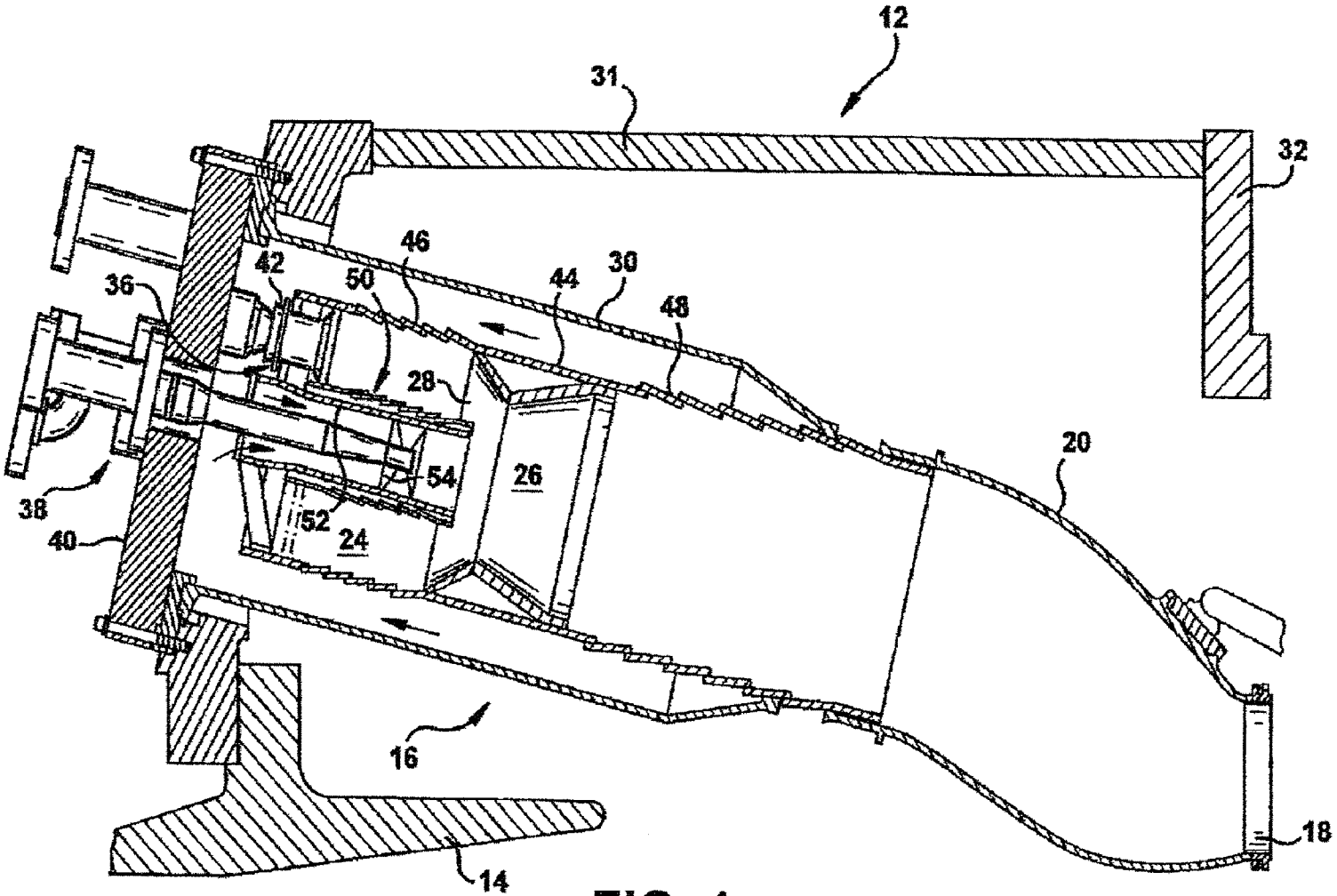
FIG. 1 (PRIOR ART)
FIG. 1 is a partial cross-sectional view of a prior art known dry low NOx combustor.

FIG. 1 illustrates a prior art combustor for a gas turbine 12, which includes a compressor 14 (partially shown), a plurality of combustors 16 (one shown for convenience and clarity), and a turbine represented by a single blade 18. Although not specifically shown, the turbine 18 is drivingly connected to the compressor 14 along a common axis. The compressor 14 pressurizes inlet air, which is then reverse flowed to the combustor 16 where it is used to cool the combustor 16 and to provide air to the combustion process. Although only one combustor 16 is shown, the gas turbine 12 includes a plurality of combustors 16 located about the periphery thereof. A transition duct 20 connects the outlet end of each combustor 16 with the inlet end of the turbine 18 to deliver the hot products of combustion to the turbine 18.

Each combustor 16 comprises a primary or upstream combustion chamber 24 and a secondary or downstream combustion chamber 26 separated by a venturi throat region 28. The combustor 16 is surrounded by a combustor flow sleeve 30, which channels compressor discharge air flow to the combustor. The combustor is further surrounded by an outer casing 31, which is bolted to the turbine casing 32.

Primary nozzles 36 provide fuel delivery to the upstream combustion chamber 24 and are arranged in an annular array around a central secondary nozzle 38. Each of the primary nozzles 36 protrudes into the primary combustion chamber 24 through a rear wall 40. Secondary nozzle 38 extends from a rear wall 40 to the throat region 28 in order to introduce fuel into the secondary combustion chamber 26. Fuel is delivered to the primary nozzles 36 through fuel lines (not shown) in a manner well known in the art.

Combustion air is introduced into the fuel stage through air swirlers 42 positioned adjacent the outlet ends of nozzles 36. The swirlers 42 introduce swirling combustion air, which mixes with the fuel from nozzles 36 and provides an ignitable mixture for combustion on startup, in chamber 24. Combustion air for the swirlers 42 is derived from the compressor 14 and the routing of air between the combustion flow sleeve 30 and the wall 44 of the combustion chamber. The cylindrical wall 44 of the combustor is provided with slots or louvers 46 in the primary combustion chamber 24, and similar slots or louvers 48 downstream of the secondary combustion chamber 26 for cooling purposes, and for introducing dilution air into the combustion zones to prevent substantial rises in flame temperature. The secondary nozzle 38 is located within a centerbody 50 and extends through a liner 52 provided with a swirler 54 through which combustion air is introduced for mixing with fuel from the secondary nozzle.

Figure 2:
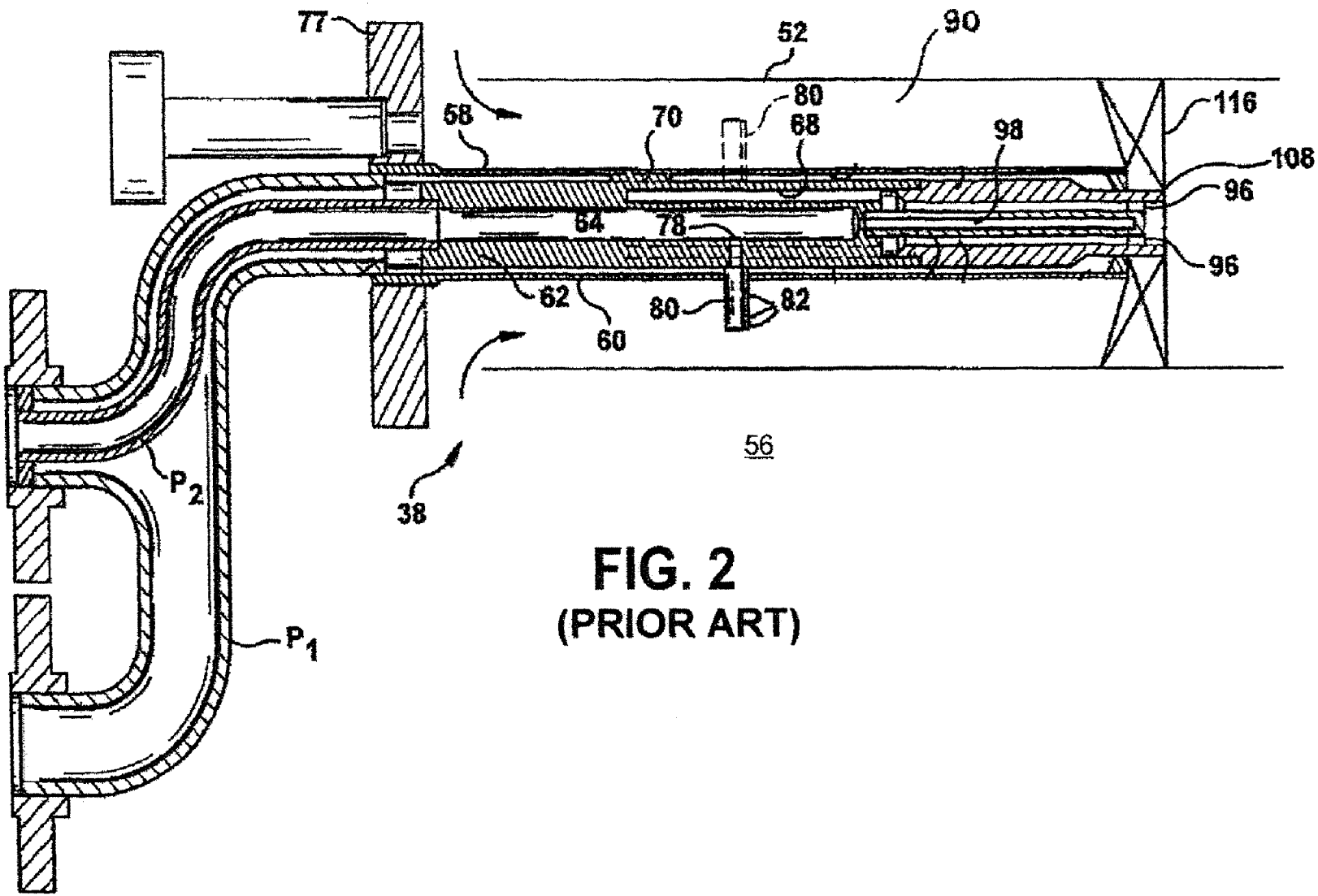
FIG. 2 (PRIOR ART)
FIG. 2 is a partial cross sectional view of a prior art secondary premixed/diffusion fuel nozzle.

Referring now to FIG. 2, a gas-only secondary fuel nozzle assembly 56 is illustrated. Fuel is supplied to sustain a flame by diffusion pipe $P_1$ and to sustain a premixed flame by pipe $P_2$ which, at the inlet to the secondary fuel nozzle assembly 56, are arranged concentrically relative to each other.

The following will primarily describe the premix fuel secondary nozzle assembly 56. A rearward component, or gas body, 58 includes an outer sleeve portion 60 and an inner hollow core portion 62 provided with a central bore forming a premix fuel passage 64. A plurality of axial air passages 68 are formed in a forward half of the rearward component 58 in surrounding relationship to the premix fuel passage 64. A like number of radial wall portions (e.g., four) are arranged about the end of sleeve portion 60 and each includes an inclined, radial aperture 70 for permitting air within the liner 52 to enter a corresponding air passage 68. The rearward end of component 58 is adapted to receive the fuel pipes $P_1$, $P_2$, respectively, as shown in FIG. 2, within a mounting flange 77.

A plurality of radial holes 78 are provided about the circumference of the forward portion of component 58, permitting a like number of radial gas injector tubes (pegs) 80 to be received therein to thereby establish communication with the premix fuel passage 64. Each peg 80 is provided with a plurality of apertures or orifices 82 so that fuel from the premix passage 64 may be discharged into a premixing area 90 between the secondary nozzle assembly 56 and liner 52 for mixing with combustion air within the liner. The pegs 80 are designed to distribute fuel into the airflow. Good mixing of fuel and air in the premixing area 90 is necessary to reduce nitrogen-oxide (NOx) emissions. A flame holding swirler 116 which may or may not be integral with the nozzle is located at the forward end of the secondary nozzle, extending radially between the reduced diameter forward end 108 and the liner 52 for swirling the premixed fuel/air flowing within the liner. Combustion air will enter the secondary nozzle assembly 56 as shown by arrows in FIG. 2 (above 38) and via holes 70, and fuel will flow through the premix passage 64, pilot bore and pilot orifice 98. This fuel, along with air from swirler slots 96, provides a diffusion flame sub-pilot. At the same time, a majority of the fuel supplied to the premix passage will flow into the gas injectors 80 for discharge from orifices 82 toward the liner 52 where it is mixed with air.

Figure 3:
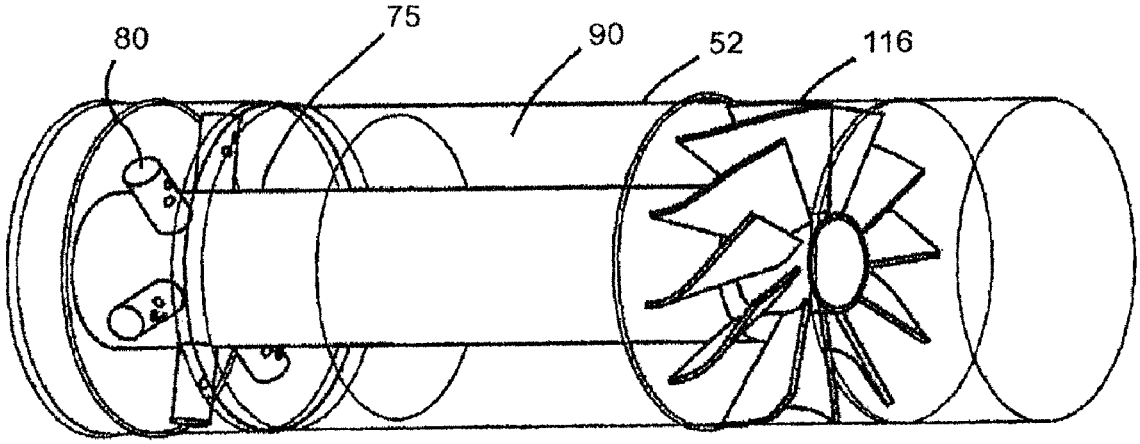
FIG. 3 (PRIOR ART)
FIG. 3 illustrates a peg arrangement for the prior art secondary fuel nozzle.
Figure 4:
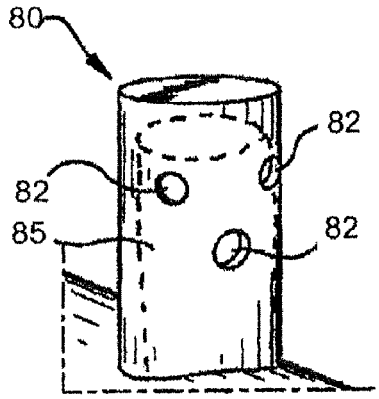
FIG. 4 (PRIOR ART)
FIG. 4 illustrates the arrangement of fuel discharge holes in the peg of the prior art secondary nozzle.

As illustrated in FIGS. 3-4, premixing of fuel with air as performed in prior art secondary fuel nozzles may include the plurality of pegs 80, equally spaced around the periphery of the secondary nozzle body 75 in the premixing volume 90. Each peg 80 may include a central cavity 85 running the length of the peg. The inner end of each peg may be attached to the nozzle body at the location of the radial fuel holes, thereby establishing communication between the fuel cavity in the nozzle body and the central cavity of the peg, as previously described with respect to FIG. 2. Along a downstream surface of the peg 80, a plurality of the fuel discharge holes 82 are provided from the central internal cavity 85, thereby providing for discharge of premix fuel into the airflow between the secondary nozzle body 75 and the liner 52. Three radially-located fuel discharge holes 82 are provided along the downstream side of the peg 80. Positioning of the hole location along the row of holes was varied. In this prior art secondary nozzle, six pegs are evenly distributed around the circumference of the secondary nozzle body 75, with three orifices for fuel dispersal along the downstream side of the peg. However, the effective mixing of fuel and air is not complete. More complete mixing of the fuel and air can lead to lower NOx emissions and more stable combustion.

The above described nozzle construction provides for the sustained premixed mode of operation via a diffusion flame pilot. However, elevated emissions from a gas turbine is the result of insufficient mixing of air and fuel prior to burning in the combustion chamber. The existing peg design, described above, is not able to mix fuel and air properly to obtain the requisite degree of mixing for low emissions. Attempts to change the location of holes in the pegs have not been able to achieve satisfactory fuel and air mixing.

Figure 5:
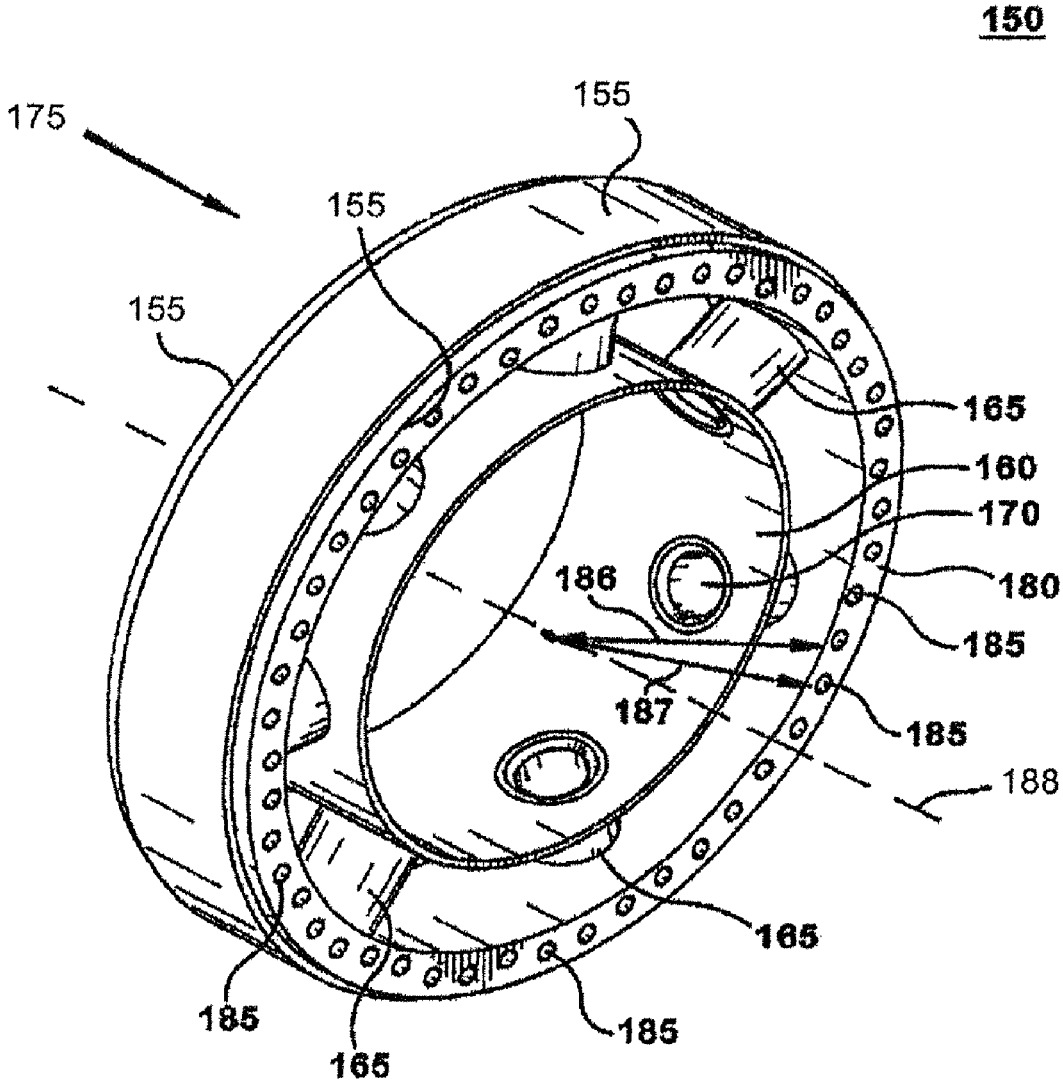
FIG. 5 (PRIOR ART)
FIG. 5 illustrates a prior art manifold for fuel premix.

FIG. 5 illustrates a fuel distribution device 150 for a secondary fuel nozzle as described in U.S. Pat. No. 6,446,439 and U.S. Pat. No. 6,282,904 by Kraft et al. An annular fuel manifold 155 is mounted to a support sleeve 160 through support cylinders 165. The manifold 155 presents a rectangular cross-section. The support sleeve 160 is affixed to the body of a secondary fuel nozzle (not shown) by welding. Fuel in the body of the secondary nozzle, passes through holes 170 in the support sleeve and through the support cylinders 165 into the hollow annular fuel manifold 155. The annular fuel manifold 155 is positioned in an airstream 175 around secondary nozzle body (not shown). Fuel is distributed from the downstream face 180 of the annular fuel manifold through an array of apertures 185. The apertures 185 may be at a first radial distance 186 or a second radial distance 187 within the airstream from a central axis 188. The direction of the apertures 185 with respect to the airflow may be collinear or at an angle. However, the rectangular-shaped annulus limits the angles that the apertures may make with respect to the direction of the airstream.

The cylindrical-shaped annular fuel manifold 155 for fuel premix distribution may provide for radial and circumferential fuel distribution over the peg arrangement. However the annular manifold has limitations on mixing, stemming from the limited flow angles that may be created with respect to the airflow, and particularly with respect to the radial and axial distribution of fuel into the airstream.

Accordingly, there is a need to provide an alternate structure to improve the fuel-air premixing in the secondary nozzle to promote lower emissions and improved combustion dynamics.

With the existing fuel pegs used to inject fuel into the mainstream air, the axial length provided to mix fuel and air is not sufficient, and unmixedness remains until this fuel/air mixture enters the combustion zone. With reference to FIGS. 6 and 7, a tubular fuel injector 200 adds axial length to better mix fuel and air and also adds cross-flow injection of fuel to promote better mixing of fuel and air.

The tubular fuel injector 200 extends from the end cover assembly 130 and is in fluid communication with the fuel manifolds forming part of the end cover assembly 130. The tubular fuel injector 200 is disposed surrounding the annular fuel passages of the fuel nozzle 132. The tubular injector 200 includes a plurality of axially oriented air slots 202 and a plurality of fuel injection holes 204 disposed between the air slots 202. With continued reference to FIGS. 6 and 7, the axially oriented air slots 202 are preferably formed in an oblong shape as shown with a major axis oriented in the axial direction. The air slots 202 are preferably evenly disposed about a circumference of the tubular fuel injector 200.

The fuel injection holes 204 are oriented such that fuel from the fuel manifold is injected in at least a radial direction to mix with air flowing through the air slots 202. Preferably, at least one of the fuel injection holes 204 is oriented axially such that fuel from the fuel manifold is injected in an axial direction to mix with the air flowing through the air slots 202. In this context, the tubular fuel injector 200 includes an end surface 206 at a distal axial end (i.e., the end farthest from the end cover assembly 30). The axially oriented fuel injection holes 204 are shown disposed in the end surface 206.

The fuel injection hole orientation thus provides a combination of cross flow and axial flow of fuel, which helps to improve the premixedness of fuel and air at the exit of the secondary fuel nozzle. Additionally, the pressure drop in the system is reduced, which helps to improve the gas turbine efficiency, resulting in more power produced for the same amount of fuel burnt.

The tubular fuel injector of the preferred embodiments provides added axial length for the fuel to mix with air providing for better mixedness. Additionally, the orientation of fuel injection holes provide for cross-flow injection of fuel into the air to provide a better mixture of fuel and air.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A secondary fuel nozzle for a gas turbine comprising:

a fuel manifold coupled with a plurality of annular fuel passages; and a tubular fuel injector in fluid communication with the fuel manifold and disposed surrounding the plurality of annular fuel passages, the tubular fuel injector comprising a plurality of axially oriented air slots and a plurality of fuel injection holes disposed between the plurality of air slots, wherein the plurality of fuel injection holes are oriented such that fuel from the fuel manifold is injected in at least a radial direction to mix with air flowing through the plurality of air slots, wherein at least one of the plurality of fuel injection holes is oriented axially such that fuel from the fuel manifold is injected in an axial direction to mix with the air flowing through the plurality of air slots, wherein the tubular fuel injector comprises an end surface at a distal axial end, and wherein the at least one axially oriented fuel injection hole is disposed in the end surface.

2. A secondary fuel nozzle according to claim 1, wherein the plurality of axially oriented air slots are formed in an oblong shape with a major axis oriented in the axial direction.

3. A secondary fuel nozzle according to claim 2, wherein the plurality of air slots are evenly disposed about a circumference of the tubular fuel injector.

4. A secondary fuel nozzle for a gas turbine comprising:

a fuel manifold coupled with a plurality of annular fuel passages;

a swirler positioned at a forward end of the secondary fuel nozzle; and a tubular fuel injector in fluid communication with the fuel manifold and disposed surrounding the plurality of annular fuel passages upstream of the swirler, the tubular fuel injector comprising a plurality of axially oriented air slots disposed about a circumference of the tubular fuel injector and a plurality of fuel injection holes disposed between the air slots, wherein the plurality of fuel injection holes comprise axially oriented injection holes and radially oriented injection holes such that fuel from the fuel manifold is injected in both a radial direction and an axial direction to mix with air flowing through the plurality of air slots, wherein the tubular fuel injector comprises an end surface at a distal axial end, and wherein the axially oriented fuel injection holes are disposed in the end surface.

5. A secondary fuel nozzle according to claim 4, wherein the plurality of axially oriented air slots are formed in an oblong shape with a major axis oriented in the axial direction.

6. A fuel injector for a secondary fuel nozzle in a gas turbine, the fuel injector positioned upstream of a fuel nozzle swirler and comprising axially oriented air slots and a plurality of fuel injection holes disposed between the air slots, wherein the plurality of fuel injection holes comprise axially oriented injection holes and radially oriented injection holes such that fuel input through the plurality of fuel injection holes is injected in both a radial direction and an axial direction to mix with air flowing through the air slots, wherein the fuel injector comprises an end surface at a distal axial end, and wherein the axially oriented fuel injection holes are disposed in the end surface.

* * * * *

UNITED STATES PATENT AND TRADEMARK OFFICE

CERTIFICATE OF CORRECTION

PATENT NO. : 8,113,001 B2
APPLICATION NO. : 12/241854
DATED : February 14, 2012
INVENTOR(S) : Singh et al.

It is certified that error appears in the above-identified patent and that said Letters Patent is hereby corrected as shown below:

At column 1, line 37, delete "a circumferential radial direction" and insert --a radial direction--

Signed and Sealed this
Tenth Day of April, 2012

David J. Kappos

David J. Kappos
*Director of the United States Patent and Trademark Office*